United States Patent [19]

Bell et al.

[11] Patent Number: 4,773,488

[45] Date of Patent: Sep. 27, 1988

[54] DEVELOPMENT WELL DRILLING

[75] Inventors: Larry N. Bell, Plano, Tex.; Randy A. Ruedrich, Anchorage, Ak.; Frank J. Schuh, Dallas, Tex.

[73] Assignee: Atlantic Richfield Company, Los Angeles, Calif.

[21] Appl. No.: 638,830

[22] Filed: Aug. 8, 1984

[51] Int. Cl.[4] ..... E21B 7/04

[52] U.S. Cl. ..... 175/61

[58] Field of Search ..... 166/52; 175/61, 75, 175/107, 73

[56] References Cited

U.S. PATENT DOCUMENTS

| | | | |
|---|---|---|---|
| 2,565,794 | 8/1951 | Young | 175/75 X |
| 3,687,204 | 8/1972 | Marshall et al. | 175/61 X |
| 4,379,493 | 4/1983 | Thibodeaux | 175/61 |
| 4,386,665 | 6/1983 | Dellinger | 175/61 |

OTHER PUBLICATIONS

"Russia 'Gang' Drills", *Oil and Gas Journal*, Dec. 10, 1956, p. 105.

"Wells Drilled with Horizontal Drain Holes", *The Petroleum Engineer*, Feb. 1947, pp. 174–180.

*Primary Examiner*—Stuart S. Levy
*Assistant Examiner*—Thomas R. Hannon
*Attorney, Agent, or Firm*—Roderick W. MacDonald

[57] ABSTRACT

A method for development drilling in a mineral producing field such as an oil and gas field wherein a plurality of wellbores are drilled in the earth through at least one mineral containing subsurface geologic formation, the plurality of wellbores being drilled from a central drill site radially outwardly therefrom wherein the wellbores are drilled at varying angles from vertical within the range of from about 30 to about 87.5 degrees from vertical, the wellbores passing through at least one formation at an angle from vertical.

3 Claims, 2 Drawing Sheets

DEVELOPMENT WELL DRILLING

BACKGROUND OF THE INVENTION

Heretofore, most wells drilled in the earth to produce oil, gas and other minerals therefrom have been drilled essentially vertically so that the wellbores penetrate the mineral producing formation essentially at right angles although not precisely at right angles because the producing formation may dip from horizontal from place to place. However, the point is that the wellbores were essentially deliberately drilled vertically and in many situations, a lot of effort was put into the drilling procedure to insure that the wellbore remained essentially vertical rather than deviating to any substantial degree to an angle from vertical.

Deviated wellbores have been drilled, particularly in offshore applications, which do curve at an angle from vertical, but no particular effort has been put into the drilling procedure to insure that the wellbores penetrated the producing formation in a systematic fashion at an angle from vertical. In fact, a particular species of deviated wellbore, known as drainhole wellbores, deliberately turns essentially a 90 degree angle from vertical at or in the producing formation so that the wellbore can be extended essentially horizontally away from the vertical primary wellbore as to stay within the producing formation. The drainhole wellbore is then drilled horizontally out into the producing formation as far as possible.

BRIEF SUMMARY OF THE INVENTION

In accordance with this invention, a plurality of wellbores are deliberately and systemically drilled so as to pass through one or more subsurface mineral producing geologic formations at an angle from vertical. Thus, pursuant to this invention, drilling a wellbore so as to pass through a formation essentially at right angles is deliberately avoided and drilling a deviated wellbore essentially horizontally in that formation is also deliberately avoided. The wellbores of this invention are drilled at an angle from vertical but not horizontal so that the wellbores pass through the formation at varying angles all of which are substantially different from vertical and horizontal. Wells drilled at these varying angles cumulatively provide for substantially greater wellbore exposure in the producing formation or formations than would be obtained by using a substantially larger number of essentially vertical wellbores. These wells can also reach a plurality of spaced apart formations which would not be achieved with drainhole wellbores that are confined to a single producing formation.

Accordingly, it is an object of this invention to provide a new and improved method for development drilling of a plurality of wells in a mineral producing field, particularly a field which contains a plurality of spaced apart subsurface geologic formations which each produce valuable minerals such as oil and gas.

Other aspects, objects and advantages of this invention will be apparent to those skilled in the art from this disclosure and the appended claims.

DETAILED DESCRIPTION OF THE INVENTION

Figure 1:
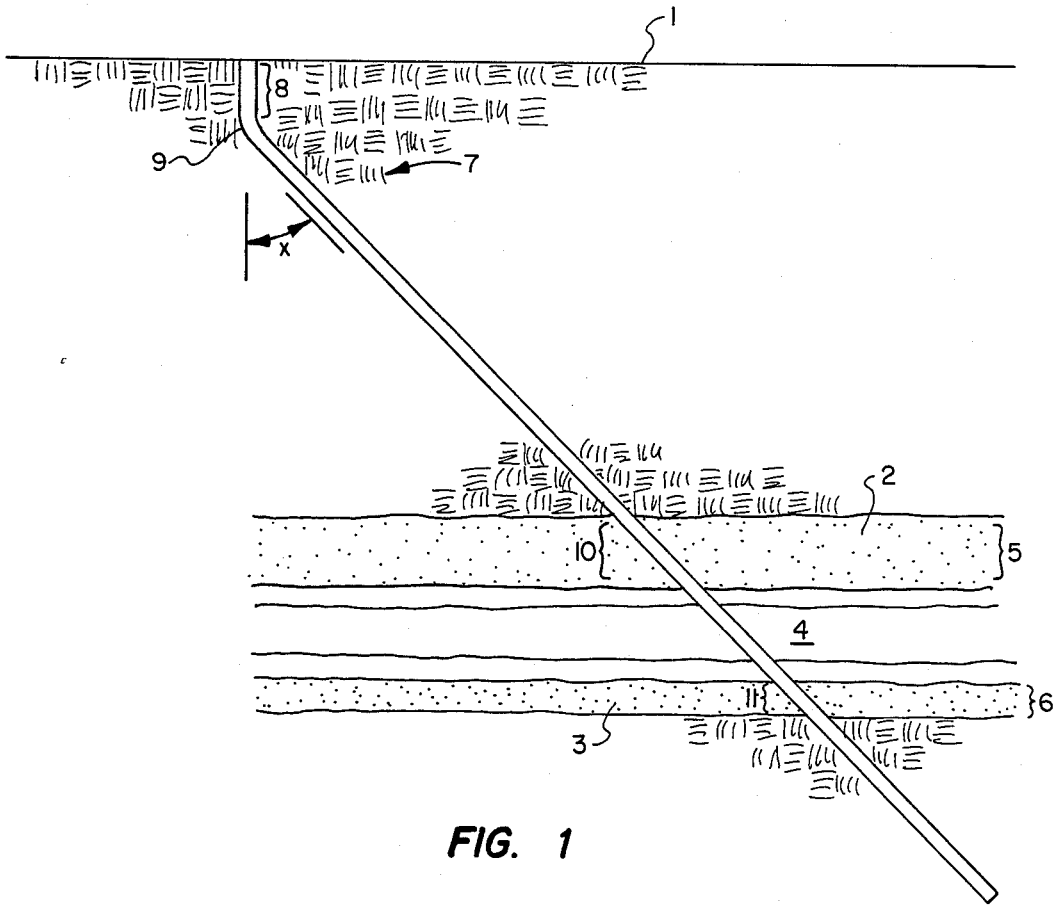
FIG. 1 shows a single inclined wellbore drilled in accordance with this invention, at an angle from vertical which passes through two subsurface mineral producing formations.

More specifically, FIG. 1 shows surface of the earth 1 which has therebelow two spaced apart mineral producing formations 2 and 3, the formations having therebetween an essentially impervious formation, such as shale formation 4, which prevents migration of minerals such as oil and gas between formations 2 and 3. Thus, each formation has to be penetrated by a wellbore in order to recover minerals therefrom. Each of formations 2 and 3 has a vertical thickness 5 and 6, respectively. Wellbore 7 penetrates earth 1 in area 8 and then deviates from vertical by an angle X at bottom 9 of vertical section 8. Wellbore 7 is then maintained at this angle from vertical and less than horizontal until wellbore 7 penetrates both formations 2 and 3. By passing through formations 2 and 3 at an angle from vertical, the length 10 of wellbore 7 exposed in formation 2 and the length 11 of wellbore 7 exposed in formation 3 are each substantially longer than the vertical height 5 and 6 of these formations. Thus, a substantially longer length of wellbore exposure in both formations 2 and 3 is obtained by deliberately maintaining the drilling direction of wellbore 7 at angle X. Although section 8 can be of any desired length (height), it is within the scope of this invention if the height of vertical section 8 were zero so that kick-off point 9 would be at or near earth's surface 1.

Figure 2:
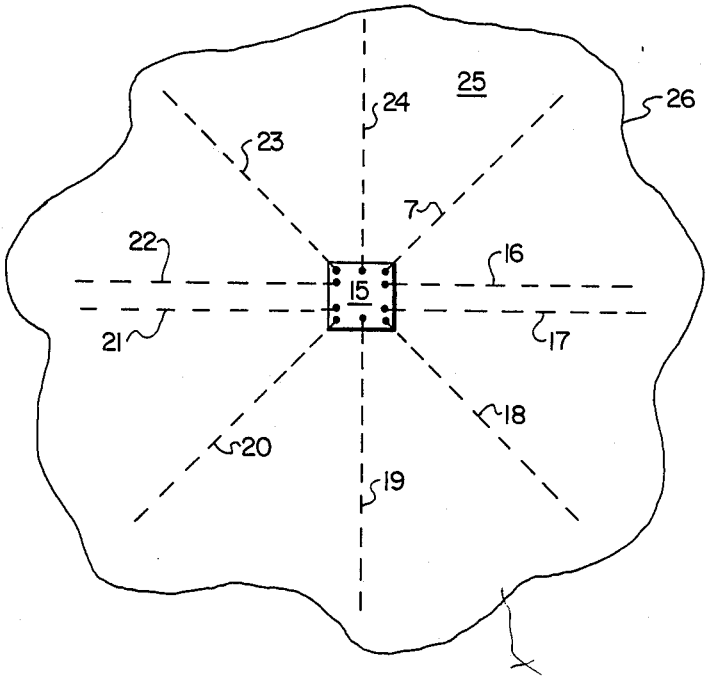
FIG. 2 is a plan view of a central drill site wherein a plurality of radially extending wellbores are drilled therefrom in accordance with this invention.

FIG. 2 shows a central drill site 15 from which inclined wellbore 7 is drilled. In accordance with this invention, a plurality of inclined wellbores, 16 through 24, inclusive, are systematically drilled from central drill site 15 radially outward therefrom in various directions and at various angles from vertical thereby to drain minerals from essentially all parts of mineral producing field 25 as denoted by boundary line 26. Such development drilling for field 25 is, in accordance with this invention, done from central drill site 15 using inclined wells such as shown in FIG. 1 so that all wellbores deliberately pass through subsurface producing formations 2, 3 and any others below the surface of field 25 in the manner shown in FIG. 1. By using this developmental drilling approach, substantially less development wells 7 and 16 through 24 need be drilled to fully develop field 25 than if vertical wells were drilled over essentially the entire ground surface of field 25. Also, substantial exposure of the development wellbores in the interior of the subsurface mineral producing formations is achieved without using the horizontal drainhole concept.

Figure 3:
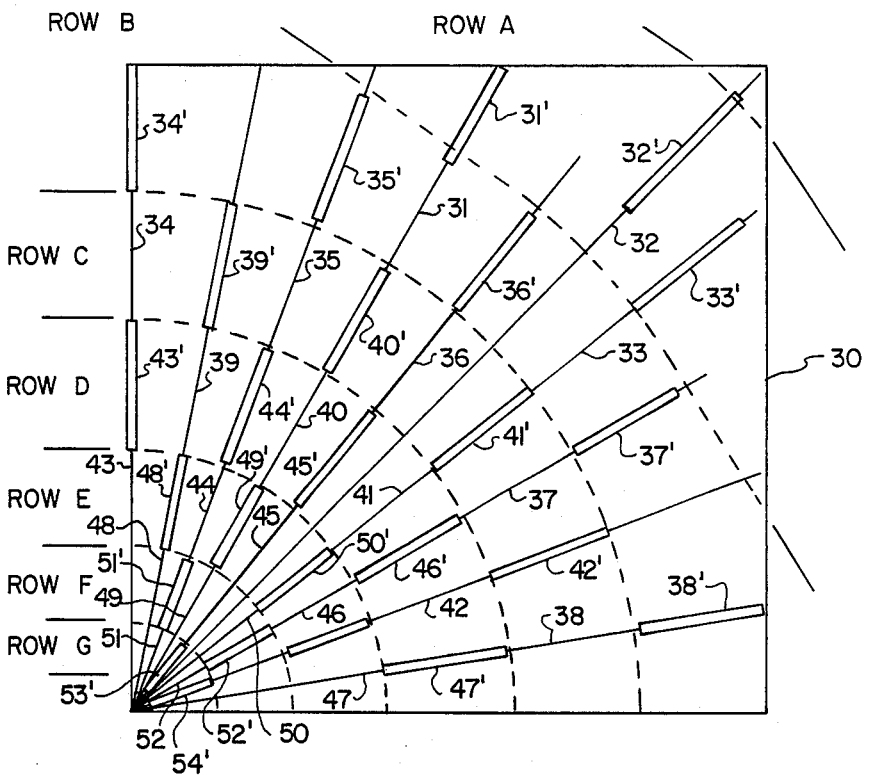
FIG. 3 shows one quadrant of development well drilling from a central well site in accordance with this invention.
Figure 5:
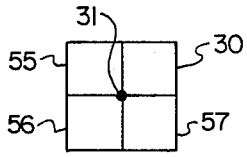
FIG. 5 is an enlarged plan view of FIG. 3.

FIG. 3 shows one specific embodiment for carrying out the development drilling concept of this invention. In FIG. 3, a one mile square section of land 30 has at point 31 a central drill site from which all wells will be drilled for developing section 30. From central drill site 31, twenty-four different wells will be drilled radially from site 31 at varying angles from vertical out to different locations in section 30. For sake of ease of description, each well is numbered and groups of wells will be designated by row. It should be noted that various other combinations of wells as to numbers and rows can be employed and still obtain good development of section 30. The embodiment shown in FIG. 3 is only one example for carrying out the general concept of this invention. In FIG. 3, twenty-four separate wells are drilled. Row A contains three wells denoted 31, 32, and 33. The blocks 31', 32', and 33' shown in FIG. 3, outline the extent wellbores 31, 32, and 33, respectively, pass through the subsurface mineral producing formation 60 shown in FIG. 4. Row B contains five wells, 34 through 38, inclusive. Row C contains four wells, 39 through 42, inclusive. Row D contains five wells, 43 through 47, inclusive. Row E contains three wells, 48 through 50, inclusive. Row F contains two wells, 51 and 52; and row G contains two wells, 53 and 54. It can be seen that by radially drilling a plurality of wells from central site 31, section 30 can be drained from just site 31. As shown in FIG. 5, sections adjacent to site 31 can similarly be developed from site 31. Three adjacent sections 55, 56, and 57, can be developmentally drilled in a manner similar to that shown for section 30 in FIG. 3 all from central site 31. Obviously, if desired, different numbers and locations of wells and locations of wells can be employed for other sections 55, 56, and 57 than shown for section 30 or the same development configuration can be used as shown in section 30 and still be within the scope of this invention.

Figure 4:
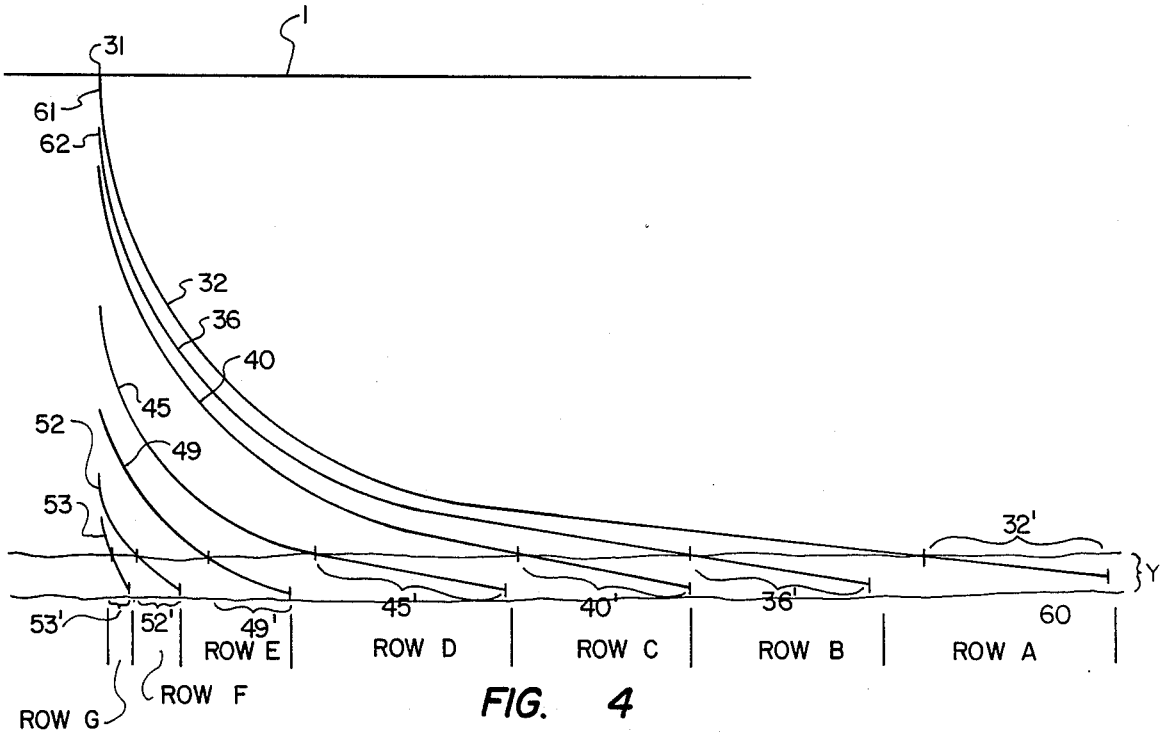
FIG. 4 is a cross sectional drawing of some of the development wells of FIG. 3.

FIG. 4 shows a cross sectional vertical location of various wells of FIG. 3 and their relationship to a subsurface mineral producing formation 60 which has a vertical pay thickness Y. In FIG. 4, the sample wells shown are 32 from row A, 36 from row B, 40 from row C, 45 from row D, 49 from row E, 52 from row F, and 53 from row G. Each well drilled from central drill site 31 extends vertically downwardly into the earth for a certain distance before the well is angled from vertical. The point at which the well is angled from vertical is called the kick-off point. The kick-off point for a specific well plus the angle at which the well is drilled after the kick-off point determines that well's angle from vertical X and the angle from vertical at which the individual well passes through producing formation 60. Thus, for well 32 kick-off point 61 is employed together with a certain wellbore angle of curvature. Thus, by fixing the depth of kick-off point 61 and the radius of curvature for well 32, the length of exposure of well 32 in formation 60, as denoted by box 32', is fixed. Similarly, well 36 with a lower kick-off point 62 and the same or different angle from vertical will pass through formation 60 at a different location from well 32 thereby establishing in formation 60, an exposure zone 36' for well 36. Similar reasoning applies for wells 40, 45, 49, 52 and 53 as shown in FIG. 4, each having different elevation kick-off points and varying radii of curvature so that each penetrates a different portion of formation 60 at a different angle from vertical. Thus, different wells have a different length of wellbore exposed in formation 60 as shown by boxes 40', 45', 49', 52', and 53'. The foregoing description holds true for all other wells shown in FIG. 3 but not shown in FIG. 4 for sake of clarity.

It is within the scope of this invention if at least part of the kick-off points for various wells are essentially at or near the earth's surface. For example, in FIGS. 3 and 4 wells 31, 32 ,and 33 could have a kick-off point at earth's surface 1 rather than substantially below surface 1 as shown for kick-off point 61 for well 31 in FIG. 4. Kick-off points at the earth's surface can be employed for other wells, particularly far reaching wells such as those in Rows A and B in FIGS. 3 and 4.

EXAMPLE

When the well development scheme of FIGS. 3 and 4 is carried out for a one square mile section and seven rows A through G with twenty-four total wells drilled at varying depths and angles from vertical. All wells penetrate producing formation 60 which is at a depth of about 3,500 feet below earth's surface 1. All wells in rows A, B, and C would have a degree of curvature or build rate of 2½ degrees per one hundred foot of wellbore length drilled. The variation of wells from row A to B to C is the depth of the kick-off point. In this example, all the wells in row A, i.e., wells 31, 32, and 33, would have a 500 foot deep kick-off point whereas all wells in row B would have a 750 foot deep kickoff point and all wells in row C would have a 1,000 foot kickoff point. The penetrations of wells in rows A, B, and C information 60 would then be at angles from vertical in the range of from about 85 to about 87½ degrees. The wells in row D would have a kick-off point of 1,500 foot depth and a build rate of 3¼ degrees per 100 foot of wellbore length. Rows E through G would utilize a build rate of 6 degrees per 100 foot of wellbore and have, respectively, kick-off points of 2,500; 3,000; and 3,200 foot depth. Thus, the wellbore in row F would penetrate formation 60 at 60 degrees from vertical while wellbores in row G would penetrate formation 60 at 30 degrees from vertical.

The sum total of the length of all wellbores in FIG. 3 exposed inside formation 60, i.e., the sum of the length of boxes 31' through 54', would be 20×1,146 feet for the 87½ degree holes plus 2×100 feet for the 60 degree holes and 2×57 feet for the 30 degree holes. This combines to provide 23,234 feet of formation exposure for the 640 acre development area 30. In order to provide 23,234 feet of formation exposure for a 50 foot depth (Y) zone 60, 464 vertical wells would be needed spaced apart over the surface of section 30 on a spacing of 1.378 acres per well. This is in stark contrast to the 24 wells from central drill site 31 as shown in FIG. 3.

It should be noted that this example is based on a single producing formation of 50 foot height. If multiple spaced apart producing formations are present as shown for formations 2 and 3 in FIG. 2, and each of the 24 wells of FIG. 3 are made to penetrate the plurality of producing formations present, then substantially greater production is achieved from the same well development scheme and even greater cost reductions per unit of mineral produced from section 30 can be realized. For example, wells in row B for the lower formation 3 would intersect the upper formation 2 in the same position as row D and wells completed in row A for the lower formation would intersect the upper formation in the positions generally shown for row C. Thus, it is possible to develop a two formation section of land with fewer than twice the number of wells shown in FIG. 3 thereby achieving an even greater potential savings when compared to vertical wells drilled over the surface of section 30.

It can be seen that by an appropriate choice of wells and angles from vertical along with the other parameters set forth in detail hereinabove, a considerable geographical area can be developmentally drilled from a single convenient drill site using a far lesser number of wells than would be needed for conventional vertical drilling. A lesser number of wells would be necessary than for drainhole drilling also since each drainhole wellbore is confined to a single formation while this invention is applicable to two or more vertically spaced formations.

This invention is useful in the production of any minerals through a wellbore such as oil, natural gas, uranium, sulphur, and the like. The invention is useful in any geographical location such as onshore, particularly arctic, and offshore locations. The invention is useful in all types of oil and gas fields, including but not limited to, those containing viscous crude oil, tar sands, oil shale, and the like.

Reasonable variations and modifications are possible within the scope of this disclosure without departing from the spirit and scope of this invention.

We claim:

1. In a method for drilling a plurality of wellbores in the earth through at least one mineral containing subsurface geologic formation to develop a mineral producing field, the improvement comprising providing a central drill site, drilling a plurality of wells from said central drill site, said wells being drilled radially outwardly in various directions from said drill site, each of said wellbores being drilled at an angle from vertical of from about 30 to about 87.5 degrees, at least one of said plurality of wellbores being drilled at an angle from vertical of from about 85 to about 87.5 degrees, at least one of said plurality of wellbores being drilled at an angle from vertical of about 60 degrees, and at least one of said plurality of wellbores being drilled at an angle from vertical of about 30 degrees, all said wellbores passing through said at least one formation at said angle from vertical so that a substantially longer length of wellbore is exposed in said at least one formation than if said wellbore were drilled essentially vertically through said at least formation.

2. The method of claim 1 wherein a plurality of vertically spaced apart subsurface mineral containing formations is present, and said wellbores penetrate a plurality of said formations at said angle from vertical.

3. The method of claim 1 wherein said wellbores are drilled at points around at least part of the periphery of said drill site.

* * * * *